US005307654A

United States Patent [19]

Ling

[11] Patent Number: 5,307,654

[45] Date of Patent: May 3, 1994

[54] COMBINATION LOCK FOR SIMULTANEOUSLY UNLOCKING AND UNCOVERING A CONTAINER

[76] Inventor: Chong-Kuan Ling, c/o Sinox Co., Ltd. P.O. Box 96-156, Taipei, Taiwan

[21] Appl. No.: 5,347

[22] Filed: Jan. 19, 1993

[51] Int. Cl.[5] ..... E05B 65/52

[52] U.S. Cl. ..... 70/71; 70/75; 70/312

[58] Field of Search ..... 70/71, 72, 75, 312, 70/315–318, 327, 328

[56] References Cited

U.S. PATENT DOCUMENTS

| | | | |
|---|---|---|---|
| D. 283,005 | 3/1986 | Gisiger | 70/312 X |
| 2,637,194 | 5/1953 | Pietri | 70/312 |
| 3,543,545 | 12/1970 | Budzyn | 70/312 X |
| 3,707,861 | 1/1973 | Lindner | 70/318 X |
| 4,719,777 | 1/1988 | Hwang | 70/316 X |
| 4,823,574 | 4/1989 | Werner | 70/312 |
| 4,852,372 | 8/1989 | Ling | 70/312 |
| 4,866,959 | 9/1989 | Ling | 70/312 X |
| 4,884,419 | 12/1989 | Ling | 70/312 X |
| 5,211,040 | 5/1993 | Gisiger | 70/312 X |

*Primary Examiner*—Lloyd A. Gall

[57] ABSTRACT

A combination lock includes a lock body having a plurality of dials and sleeves rotatably mounted therein and secured on a container cover movably secured to a container such as a hand bag, a brief case, a luggage, or any containers for storing materials or objects in the container having a slide controller slidably held in the lock body to be engageable with a locking member secured on the container, whereby upon an actuation of the controller for disengaging the lock body secured on the cover from the locking member secured on the container, the cover can be directly lifted from the operating situation when unlocking the lock body on the cover for conveniently opening the cover of the container.

6 Claims, 4 Drawing Sheets

COMBINATION LOCK FOR SIMULTANEOUSLY UNLOCKING AND UNCOVERING A CONTAINER

BACKGROUND OF THE INVENTION

A conventional combination lock as provided on a brief case or hand bag B as shown in FIG. 1 includes a lock body having combination dials D rotatably mounted on the lock body secured on the case or bag B, and a shackle H secured to a cover R movably secured to the bag B for closing (C) the bag when the shackle H is engaged into a socket S recessed in the lock body which is provided with push button P thereon for depressibly unlocking the lock for opening (0) the cover R from the bag B.

However, when opening the cover R from the bag B, the dials D should be first rotated to an openable combination and the push button P is then depressed (as shown in an arrow direction of FIG. 1) for disengaging the shackle H from the lock body mounted on the bag B. Finally, the cover R can be lifted for uncovering the bag or case B, thereby causing an inconvenient unlocking and uncovering operation for the user.

SUMMARY OF THE INVENTION

The object of the present invention is to provide a combination lock including a lock body having a plurality of dials and sleeves rotatably mounted therein and secured on a container cover movably secured to a container such as a hand bag, a brief case, a luggage, or any containers for storing materials or objects in the container having a slide controller slidably held in the lock body to be engageable with a locking member secured on the container, whereby upon an actuation of the controller for disengaging the lock body secured on the cover from the locking member secured on the container, the cover can be directly lifted from the operating situation when unlocking the lock body on the cover for conveniently opening the cover of the container.

DETAILED DESCRIPTION

Figure 2:
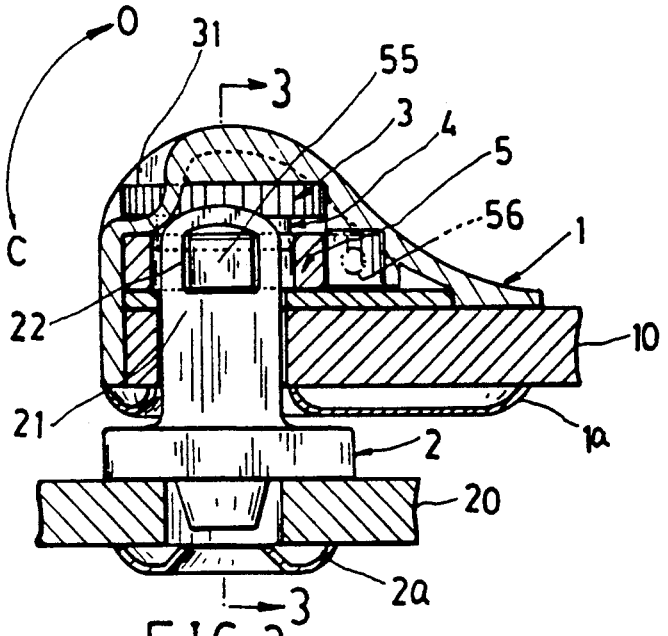
FIG. 2 is a sectional drawing of the present invention when locked.
Figure 1:
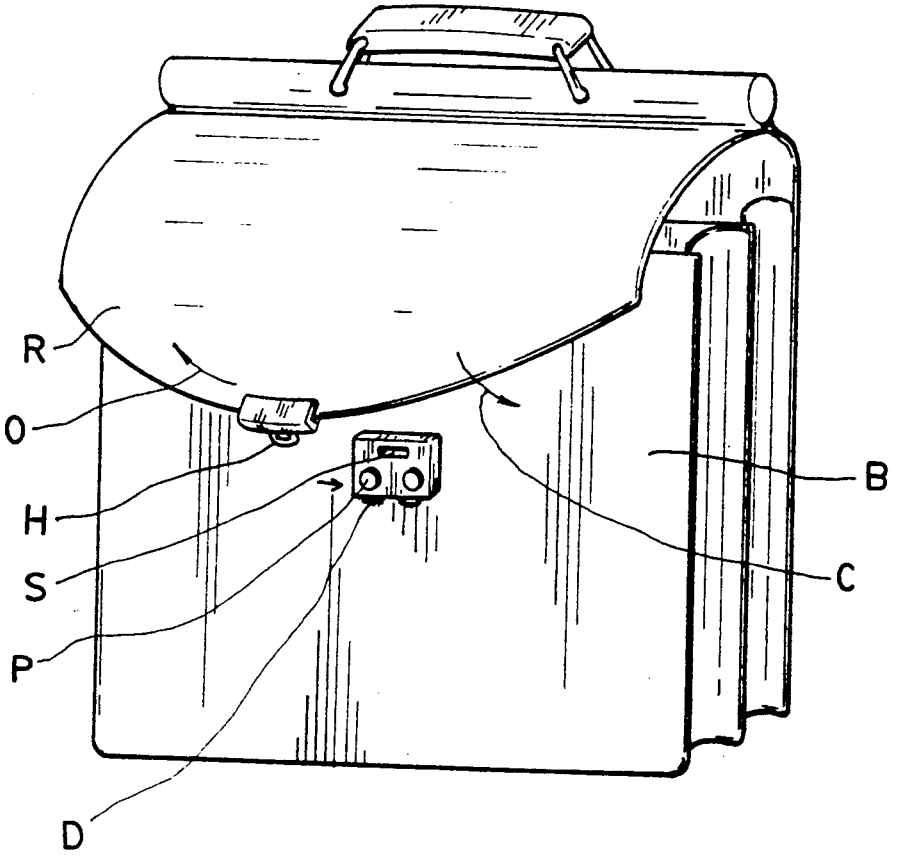
FIG. 1 PRIOR ART
FIG 1 shows a prior art of a conventional combination lock provided on a hand bag.

As shown in FIGS. 2-7, the present invention comprises: a lock body 1, a locking means 2, a plurality of dials 3 and sleeves 4 rotatably mounted in the lock body 1, and a control means 5 slidably held in the lock body 1.

The lock body 1 is secured on a cover 10 or cover edge portion of a container 20 selected from: a hand bag, a brief case, a luggage and any other containers for storing materials, objects or articles therein, while the locking means 2 is secured on the container 20 to be projectively corresponding to the lock body 1.

The lock body 1 is secured on the container cover 10 by a cover fixing member 1*a* (such as conventional screws and washer) and includes: an inner cavity 11 recessed in the lock body 1, a plurality of pivoting stems 12 protruding inwardly towards the locking means 2 secured on the container 20 from a base portion 11*a* of the lock body 1 for rotatably mounting the plurality of dials 3 and sleeves 4 on the stems 12, a button hole 13 formed in an opened side portion (B) of the lock body 1 for reciprocatively holding a push-button portion 51 of the control means 5 in the button hole 13, a plurality of base protrusions 14 circularly formed on the base portion 11*a* of the lock body 1 for rotatably engaging a plurality of dial recesses 33 annularly formed in a bottom portion of each dial 3, a guiding groove 15 longitudinally recessed in the lock body 1 for slidably holding an elongate sliding plate 50 of the control means 5 in the guiding groove 15, a spring socket 16 formed in the lock body juxtapositional to the guiding groove 15 for retaining a restoring spring 57 of the control means 5 therein, a fixed handle portion 17 formed on a closed side portion (A) of the lock body 1 protruding sidewards from the lock body 1 to be opposite to the push-button portion 5 of the control means 5 formed on the opened side portion (B), a stopping stem 18 formed in the lock body 1 adjacent to the push-button hole 13 for limiting an outward movement of the push-button portion 51 of the control means 5 for preventing a release of the control means 5 from the lock body 1, and a bolt hole 19 formed through a sealing plate 11*b* sealing the inner cavity 11 of the lock body and overlaid on the container cover 10.

Figure 3:
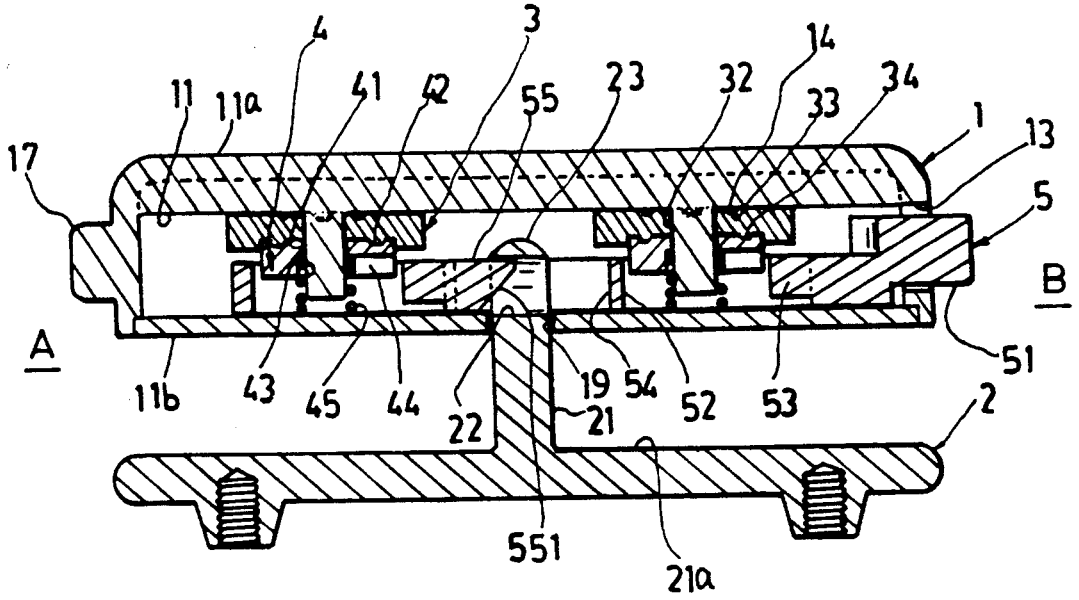
FIG. 3 is a sectional drawing of the present invention when viewed from 3—3 direction of FIG. 2.

The locking means 2 as shown in FIGS. 2, 3 includes: a locking bolt 21 protruding outwardly (or upwardly) from a bolt base member 21*a* secured on the container 20 by a container fixing member 2*a* (such as screws and washer), having a lateral slot 22 formed through an outer (or upper) portion of the locking bolt 21 to be engageable with a locking tongue 55 of the control means 5, and an arcuate or tapered tip portion 23 formed on an outermost end portion of the bolt 21.

Each dial 3 includes: a plurality of numbers 31 such as: 0, 1, 2, - - - 9, annularly formed in an inner surface of the dial 3 for identifying the combinations of the lock, a pivot hole 32 formed in the central portion of the dial to be rotatably engaged with each pivoting stem 12 formed in the lock body 1 for rotatably mounting each dial on each pivoting stem 12, a plurality of dial recesses 33 annularly recessed in a bottom surface of the dial 3 to be rotatably engageable with the plurality of base protrusions 14 annularly formed in the lock body 1, and a plurality of dial protrusions 34 annularly formed on an outer surface of the dial engageable with a plurality of sleeve recesses 42 annularly recessed in each sleeve 4 for coupling each dial 3 with each sleeve 4 as resiliently urged by a tensioning spring 45 retained in the lock body 1.

Each sleeve 4 includes: a central hole 41 engageable with the pivoting stem 12 in the lock body 1, a plurality of the sleeve recesses 42 annularly formed in an inner surface of the sleeve 4 to be engaged with the plurality of dial protrusions 34, a notch 44 radially cut in the dial engageable with a projection 53 formed in the sliding plate 50 of the control means 5, and a spring seat 43 annularly disposed around the central hole 41 for retaining the tensioning spring 45 on the spring seat 43 for resiliently coupling each sleeve 4 with each dial 3 for a coupled rotation of the sleeve with the dial.

The number, arrangement and assembly of the dials 3 and sleeves 4 are not limited in this invention. As shown in the figures, there are two dials 3 and two sleeves 4 provided in this invention.

The control means 5 includes: an elongate sliding plate 50 slidably held in a guiding groove 15 formed in the lock body 1, a push-button portion 51 secured to the sliding plate 50 and protruding outwardly through a button hole 13 positioned at an opened side portion B of the lock body 1 for depressibly unlocking the lock and for serving as a movable handle portion in cooperation with a fixed handle portion 17 formed on a closed side portion A of the lock body 1 for conveniently lifting the lock body 1 and the container cover 10 for uncovering the container 20, a plurality of sleeve slots 52 each slot 52 generally elliptical shaped and larger than each sleeve 4 which is slidably held in each slot 52, and each slot 52 having a projection 53 protruding longitudinally from an edge portion of each slot 52 towards a closed side portion A of the lock body 1 for operatively engaging a notch 44 cut through each sleeve 4 when inwardly depressing the push-button portion 51 for unlocking the lock of the present invention, a tongue slot 54 for slidably inserting the locking bolt 21 of the locking means 2 therethrough for engaging the locking tongue 55 longitudinally protruding from an edge portion of the tongue slot 54 towards an opened side portion B of the lock body 1 for engaging the lateral slot 22 in the locking means 2 for closing the cover 10 on the container 20, a restoring spring 57 retained on a spring retainer 56 formed on the sliding plate 50 and in a spring socket 16 formed in the lock body 1 for normally urging the push-button portion 51 outwardly for depressibly disengaging the locking tongue 55 from the locking bolt 21 of the locking means 2 for opening the cover 10 from the container 20, and a shoulder portion 58 formed on the sliding plate 50 adjacent to the push-button portion 51 as limited by a stopping stem 18 formed in the lock body 1 thereby preventing a releasing of the sliding plate 50 from the lock body 1.

The control means 5 has each sleeve slot 52 provided for a free rotation of each sleeve 4 in said sleeve slot 52, with each projection 53 being operatively retarded against a peripheral surface circumferentially formed on each sleeve 4 for normally locking the control mean 5 for preventing a disengagement of the lock body 1 from the locking means 2 for normally locking the cover 10 on the container 20, whereby upon a depression of the push-button portion 51 to retract the sliding plate 50 inwardly into an inner cavity 11 of the lock body 1, the locking tongue 55 will be disengaged from the locking bolt 21 for unlocking the lock body 1 from the locking means 2 for opening the cover 10 from the container 20.

The locking tongue 55 of the control means 5 is formed with an inclined surface 551 tapered sidewards towards the closed side portion A of the lock body 1 for a smooth tangential thrusting movement of the tongue 55 as impacted by the arcuate tip portion 23 of the locking bolt 21, thereby engaging the tongue 55 with the lateral slot 22 in the locking bolt 21 for coupling the lock body with the locking means.

Figure 4:
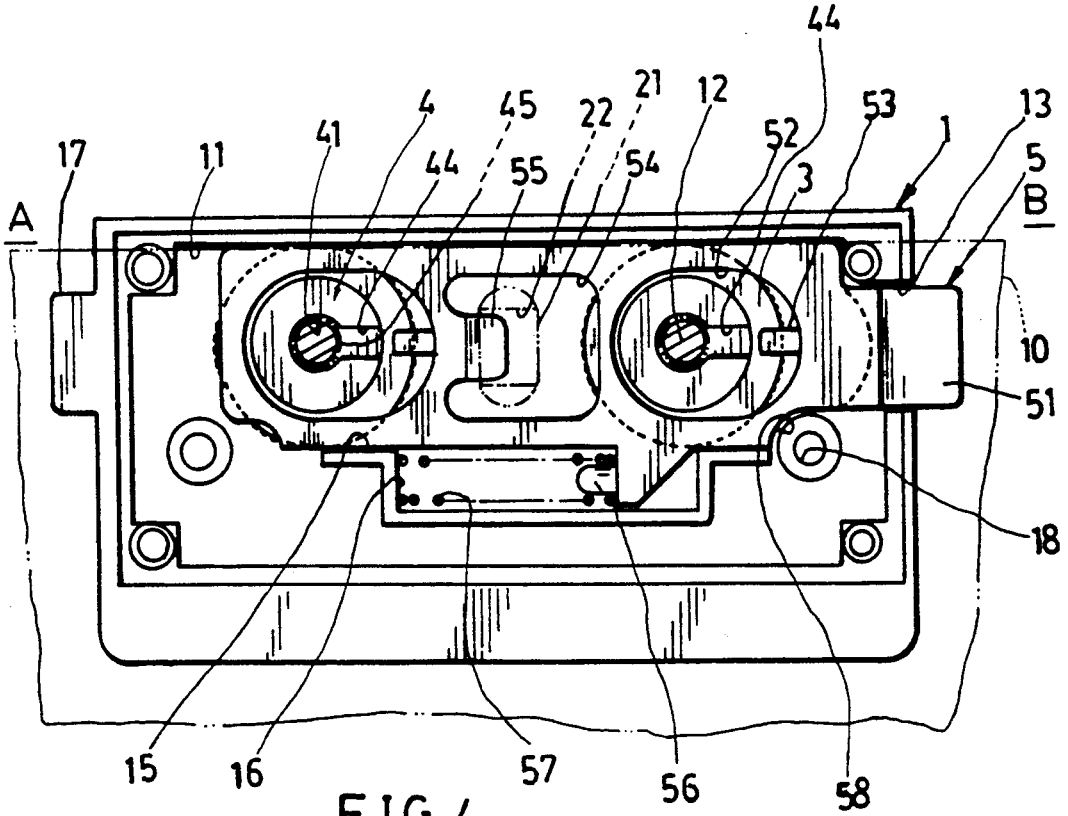
FIG. 4 is an illustration showing an interior mechanism of the lock body of the present invention when lifting the container cover from the container.
Figure 5:
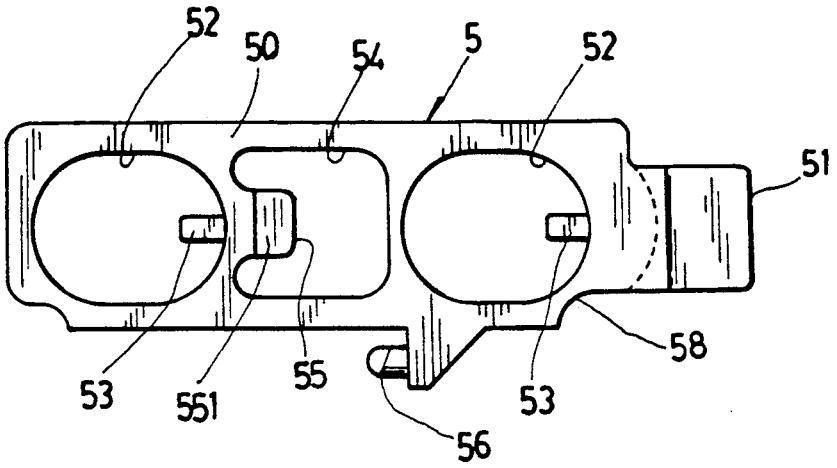
FIG. 5 is an illustration showing a control means of the present invention.
Figure 6:
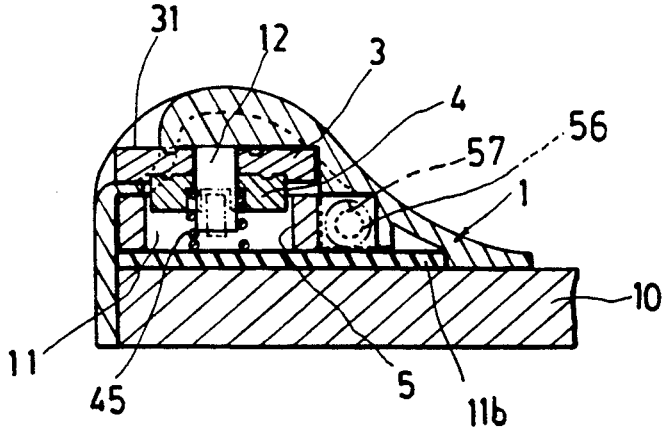
FIG. 6 is a sectional drawing of the lock body of the present invention.
Figure 7:
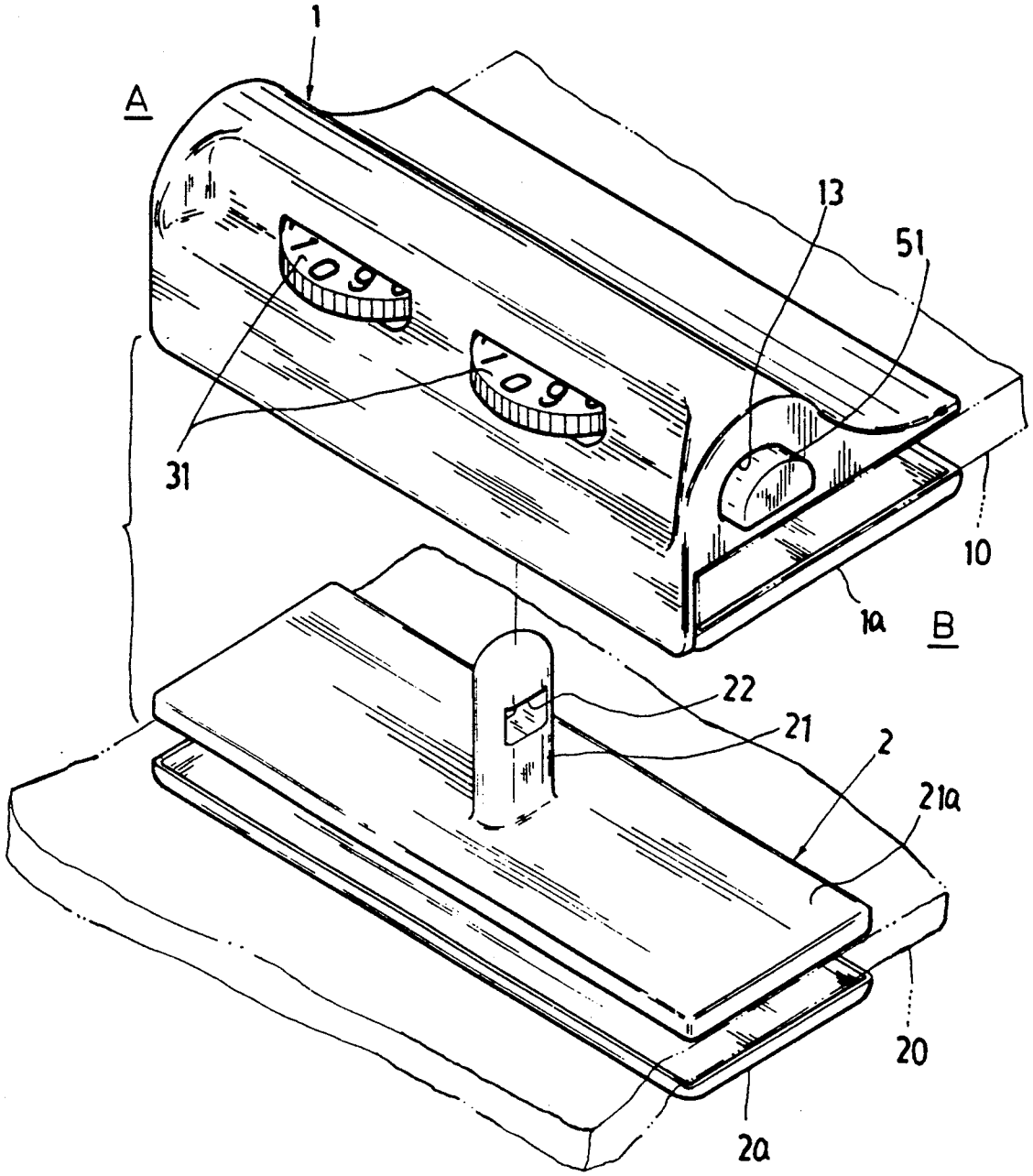
FIG. 7 is a perspective view of the present invention.

For opening the combination lock of this invention, the dials are rotated to also rotate the sleeves 4 to match each notch 44 of the sleeve 4 with each projection 53 of the control means 5 as shown in FIG. 4 whereby upon a depression of the push-button portion 51 of the control means 5, each projection 53 will be snugly received into each sleeve notch 44, allowing a retraction of the tongue 55 from the locking bolt 21 of the locking means 2 for unlocking the lock body 1 from the locking means 2. Therefore, an operator may unlock the combination lock by depressing the push-button portion 51 and by simultaneously holding such a "movable handle" as effected by the push-button portion 51 in cooperation with the fixed handle 17 for opening (0) the cover 10 from the container 20 for a convenient and ergonomic unlocking and uncovering operation of the container.

When the sleeve notch 44 is not matched with the projection 53 of the control means 5, the depression of the push-button portion 51 secured with the sliding plate 50 will be inoperative since each projection 53 is retarded on a circumferential periphery of each sleeve 4, thereby locking the lock body 1 with the locking means 2 for locking and closing (C) the cover 10 on the container 20.

For changing a combination of the present invention, the push-button portion 51 is firmly depressed at an unlocked condition as shown in FIG. 4 to "lock" each projection 53 with each sleeve notch 44, thereby braking the free rotation of the sleeves 4 and allowing a re-setting of new combination by further rotating the dials 3 to a new number.

The locking mechanism or the "handles" (17, 51) of the present invention may be further modified by those skilled in the art without separating from the spirit and claiming scope of this application.

I claim:

1. A combination lock comprising: a lock body mounted on a container cover movably secured to a container for storing materials and objects therein, having a plurality of dials and sleeves rotatably mounted in said lock body; a control means slidably held in said lock body and operatively unlocking the combination lock by driving said dials and said sleeves to an openable combination as predetermined in said dials and said sleeves; and a locking means secured on said container at a position on said container to be projectively positioned beneath said lock body on said container cover when said cover is closed on said container, and engageable with said control means in said lock body, said control means having a movable handle portion protruding outwardly beyond said lock body, and said lock body having a fixed handle portion protruding sidewardly opposite to said movable handle portion, said movable handle portion and said fixed handle portion being manually held for opening the cover from the container, whereby upon sliding of said control means for disengaging said control means from said locking means for unlocking said control means from said locking means for unlocking said lock body from said locking means, said lock body secured with said container cover can be lifted for conveniently opening the cover from the container.

2. A combination lock according to claim 1, wherein said lock body is secured on the container cover by a cover fixing member and includes: an inner cavity recessed in the lock body, a plurality of pivoting stems protruding inwardly towards the locking means secured on the container from a base portion of the lock body for rotatably mounting the plurality of dials and sleeves on the stems, the movable handle portion being defined by a push-button portion, a button hole formed in a side portion of the lock body for reciprocatively holding the push-button portion of the control means, a plurality of base protrusions circularly formed on the base portion of the lock body for rotatably engaging a plurality of dial recesses annularly formed in a bottom portion of each dial, a guiding groove longitudinally recessed in the lock body for slidably holding an elongate sliding plate of the control means in the guiding groove, a spring socket formed in the lock body juxtapositional to the guiding groove for retaining a restoring spring of the control means therein, the fixed handle portion formed on a closed side portion of the lock body protruding sidewards from the lock body to be opposite to the push-button portion of the control means, a stopping stem formed in the lock body adjacent to the push-button hole for limiting an outward movement of the push-button portion of the control means in the lock body, and a bolt hole formed through a sealing plate sealing the inner cavity of the lock body and overlaid on the container cover.

3. A combination lock according to claim 2, wherein said locking means includes: a locking bolt protruding outwardly from a bolt base member secured on the container by a container fixing member, having a lateral slot formed through an outer portion of the locking bolt to be engageable with a locking tongue of the control means when the bolt is inserted through the bolt hole in the lock body, and an arcuate top portion formed on an outer most end portion of the bolt.

4. A combination lock according to claim 3, wherein said control means includes: a plurality of sleeve slots in said sliding plate, each said slot being generally elliptical in shape and being larger than each said sleeve which is slidably held in each said slot, and each said slot having a projection protruding longitudinally from an edge portion of each said slot towards the closed side portion of the lock body for operatively engaging a notch cut through each said sleeve when inwardly depressing the push-button portion for unlocking the combination lock, a tongue slot formed in the sliding plate for slidably inserting the locking bolt of the locking means therethrough for engaging the locking tongue longitudinally protruding from an edge portion of the tongue slot towards the button hole portion of the lock body for engaging the lateral slot in the locking means for closing the cover on the container, the restoring spring retained on a spring retainer formed on the sliding plate and in the spring socket formed in the lock body for normally urging the push-button portion outwardly for depressibly disengaging the locking tongue from the locking bolt of the locking means for opening the cover from the container, and a shoulder portion formed on the sliding plate adjacent to the push-button portion as limited by the stopping stem formed in the lock body.

5. A combination lock according to claim 4, wherein said control means has each said sleeve slot providing for a free rotation of each said sleeve in said sleeve slot, with each said projection being operatively retarded against a peripheral surface circumferentially formed on each said sleeve for normally locking the control means for preventing a disengagement of the lock body from the locking means for normally locking the cover on the container, whereby upon a depression of the push-button portion after dialing the openable combination to retract the sliding plate inwardly into said inner cavity of the lock body, the locking tongue will be disengaged from the locking bolt for unlocking the lock body from the locking means for opening the cover from the container.

6. A combination lock according to claim 4, wherein said locking tongue of the control means is formed with an inclined surface tapered sidewards towards the closed side portion of the lock body for a smooth tangential thrusting movement of the tongue as impacted by the arcuate tip portion of the locking bolt, thereby engaging the tongue with the lateral slot in the locking bolt for coupling the lock body with the locking means.

* * * * *